United States Patent [19]

Wahl et al.

[11] 4,037,723

[45] July 26, 1977

[54] DISK SEPARATOR

[75] Inventors: Harold F. Wahl, Portland; James L. Keating, Boring, both of Oreg.

[73] Assignee: Rader Companies, Inc., Portland, Oreg.

[21] Appl. No.: 573,892

[22] Filed: May 2, 1975

[51] Int. Cl.[2] ..... B07B 13/04

[52] U.S. Cl. ..... 209/104; 209/361

[58] Field of Search ..... 209/233, 104, 105, 271, 209/361, 87; 29/25.41, 116; 33/180 R, 182; 171/116

[56] References Cited

U.S. PATENT DOCUMENTS

| | | | |
|---|---|---|---|
| 836,869 | 11/1906 | Deauer | 209/104 X |
| 890,453 | 6/1908 | Rice | 33/180 R X |
| 1,014,493 | 1/1912 | Cauritzen | 209/361 X |
| 1,622,052 | 3/1927 | Rickets | 29/25.41 X |
| 1,679,593 | 8/1928 | Williamson | 209/104 |
| 2,138,254 | 11/1938 | Mink | 33/180 X |
| 3,146,563 | 9/1964 | Walters | 29/116 X |
| 3,192,639 | 7/1965 | Tomasko | 33/182 |
| 3,265,206 | 8/1966 | Allen | 209/104 |

*Primary Examiner*—Robert Halper

*Attorney, Agent, or Firm*—Klarquist, Sparkman, Campbell, Leigh, Hall & Whinston

[57] ABSTRACT

A separator of the type having interleaved rotating discs is constructed with a first shaft having a locating ring welded to the longitudinal midpoint thereof and a second shaft parallel to the first shaft having a feed disc welded to its longitudinal midpoint. Feed discs and intermediate spacers are removably mounted on the shafts with the feed discs on one shaft overlapping and centered between the feed discs on the other shaft. Each feed disc is cut from steel plate, is placed on a splining shaft of a lathe head with one face of the disc in abutment with the ends of three posts defining a plane and a first groove is skin cut in the other face of the disc. The disc is then reversed on the lathe head, and a second groove is skin cut in the opposite face to a depth leaving a predetermined thickness between the groove bottoms whereby the feed discs can be accurately positioned and rotate without interference with one another.

6 Claims, 7 Drawing Figures

30
28
52
50
16
48
26
34
42
3
-26-
38
48
52
30
28
30
50
48
46
44
22
52
20
14
-24-
40
70
3
32
36
48
52
50
22
30

14
32
40
70
66
20
35
66
26
38
42
16

DISK SEPARATOR

BACKGROUND OF THE INVENTION

The present invention relates to a separator of the type having a plurality of parallel rows of interleaved discs rotating in the same direction whereby material fed onto the tops of the discs will be passed along from one row to the next, the finer material dropping through the spaces between adjacent discs, the coarser material being carried along on top of the discs whereby separation of fine and coarse material may be obtained. A problem exists with such separators in maintaining clearance between discs when spacing is close. The present invention provides means for accurately spacing the dics of one row relative to those of an adjacent row and for rapidly and easily changing the spacing of the discs in the event it is desired to obtain a different degree of separation.

BRIEF DESCRIPTION OF THE INVENTION

This invention relates to an improved separator and method of making the same, and has for an object thereof the provision of a new and improved rotating disc separator and method of making the same.

Another object of the invention is to provide an improved separator having closely spaced, overlapping discs precisely positioned along shafts driving the discs.

A further object of the invention is to provide an improved separator having overlapping discs staggered on alternate shafts with spacers between the discs seated in skin cut grooves in the discs.

Another object of the invention is to provide an improved separator having overlapping feed discs on parallel shafts, with every other shaft having a locating ring fixed thereto at its longitudinal midpoint and each of the other shafts having a feed disc fixed thereto at its longitudinal midpoint.

Another object of the invention is to provide an improved method of making a separator wherein discs are skin cut to form grooves in opposite faces thereof to provide parallel planar seating surfaces spaced a predetermined distance apart against which tubular spacers abut.

DRAWINGS

DETAILED DESCRIPTION

Figure 1:
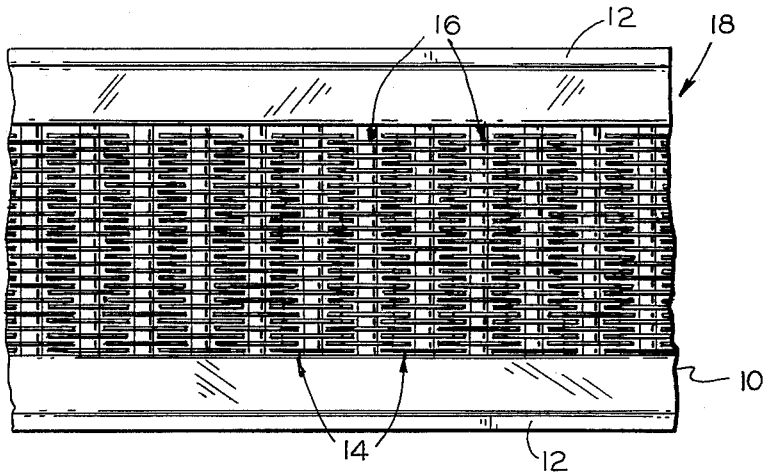
FIG. 1 is a fragmentary, top plan view of an improved separator forming one embodiment of the invention.

Referring now in detail to the drawings, there is shown therein an improved separator and method of making the same forming specific embodiments thereof. The illustrated separator includes a frame 10 having sides 12 and a pluralityof rotatable disc assemblies 14 and 16 supported from the frame. Each disc assembly 14 includes a square tubing shaft 24 having stub shafts 22 welded thereto and journaled in radial and thrust bearings 34 carried by the frame 10. Each disc assembly 16 includes a square shaft 26 having stub shafts 28 welded thereto and journaled in radial and thrust bearings 30. The disc assemblies 14 and 16 have interleaved or overlapping feed dics 32 and 34 splined thereto which are formed with rectangular axial openings 35 so that they can simply be slid upon the respective shaft and be driven thereby. The discs 32 are separated by tubular spacers 36 and the discs 34 are separated by tubular spacers 38, the spacers having an inner diameter just slightly greater than the diagonal dimension of the shafts 20, 26 so that such spacers can be slid in place over the shafts.

Figure 2:
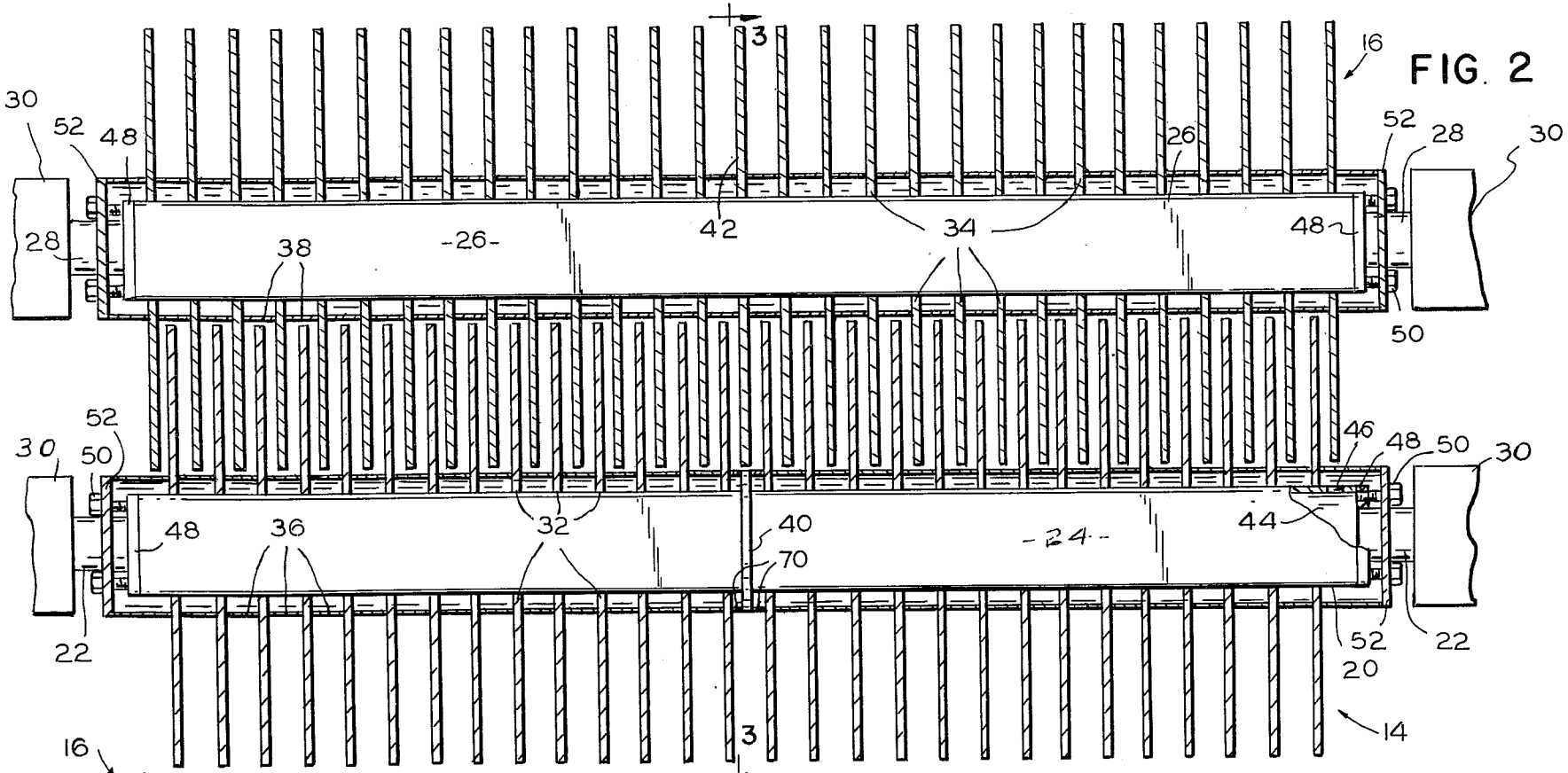
FIG. 2 is an enlarged, fragmentary horizontal sectional view of the improved separator of FIG. 1.
Figure 3:
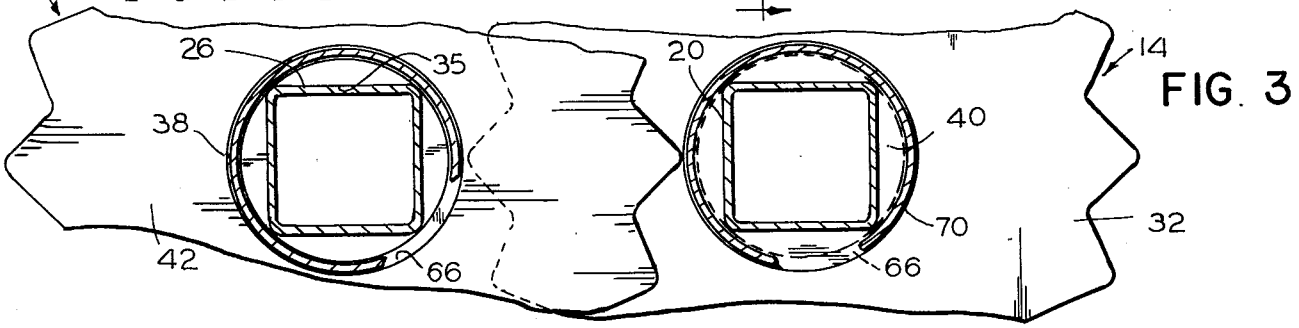
FIG. 3 is an enlarged, fragmentary, vertical sectional view taken along line 3—3 of FIG. 2.

To precisely position the discs 32 and 34 on the shafts 24 and 26, each shaft 24 has a circular locating ring or disc 40 (FIG. 2) welded thereto at its longitudinal center or midpoint, and each shaft 26 has a locating feed disc 42 welded thereto at its longitudinal center or midpoint, and the shafts are journaled with the locating spacer ring 40, and the locating disc 42 laying in the same plane. The stub shafts 22 and 28 have enlarged portions 44 fitting closely into the shafts 20 and 26 and rigidly secured therein by plug welds 46. Collars 48 welded to the ends of the shafts 20 and 26 and extending over the end portions 44 each has four tapped bores therein. Capscrews 50 are screwed into these tapped bores to press end plates 52 against the endmost spacers 36 and 38 to hold the spacers and feed discs tightly between the end plates and the corresponding ring 40 or locating disc 42.

Figure 4:
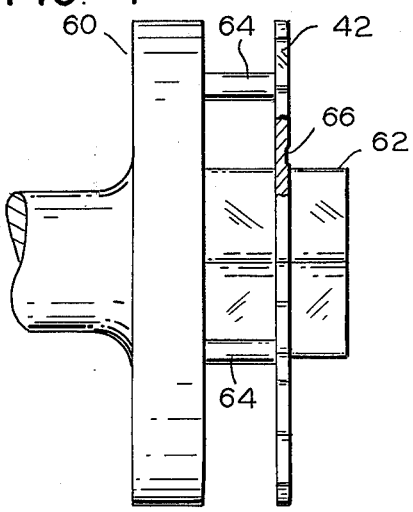
FIG. 4 is a fragmentary, side elevation view of a feed disc of the separator of FIG. 1 and a lathe head fixture during one step of a method forming one embodiment of the invention.
Figure 5:
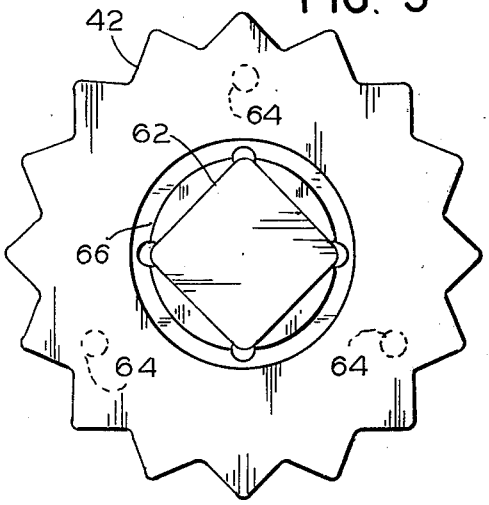
FIG. 5 is an end view of the disc and lathe head fixture of FIG. 4.
Figure 6:
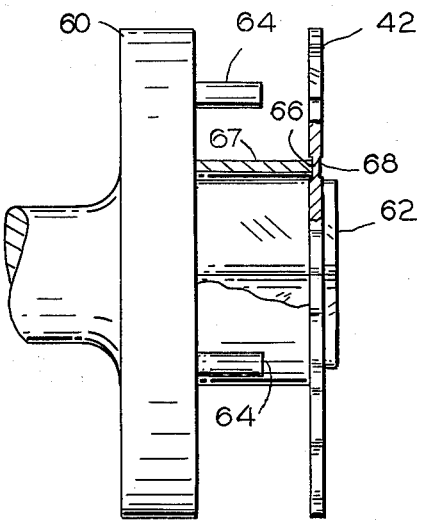
FIG. 6 is a view similar to FIG. 4 but showing the arrangement of the disc for working the opposite face thereof.
Figure 7:
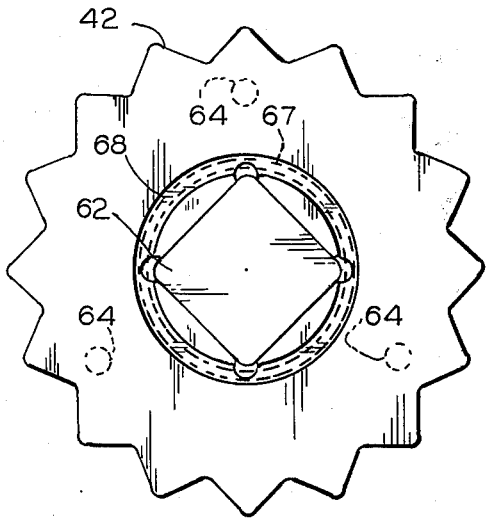
FIG. 7 is an end view of the disc and lathe head fixture of FIG. 6.

The discs 32, 34 and 42 are economically manufactured by cutting or stamping them from steel plate. However, such plates are never truly flat nor of uniform thickness, and the discs tend to be warped and also of uneven thickness. This can create problems if the discs are closely spaced because discs on adjacent shafts can interfere with one another. To minimize the effect of warpage and unequal thickness the plates are treated so as to provide an area of uniform thickness having axially normal planar opposite surfaces for engagement by the spacers 36 or 38. For example, the plates can be subjected to a high pressure pressing operation between opposed planar dies which are adapted to engage the annular spacer engaging areas of the disc surrounding the center opening therein. Alternatively, before mounting on the shafts 20, 26, each disc is placed on a rotatable lathe head fixture 60 (FIGS. 4 and 6) having a square stub shaft 62 (like the shafts 20 and 26) and is pressed against three equal length locating posts 64 whose free ends define a plane. Then the head is rotated and a milling head (not shown) cuts a shallow, skin cut, groove 66 having a planar bottom parallel to the plane of the ends of the locating posts. The disc is then removed from the fixture 60 and a spacer ring 67 positioned on the shaft 62. The disc is reversed and replaced on the shaft 62 with the bottom of the groove 66 engaged against the spacer 67 and a shallow, skin cut groove 68 formed having a planar bottom parallel to the bottom of the groove 66 cut in the opposite face to leave a predetermined thickness between the two grooves. The cuts are preferably of minimum thickness, the depth of the grooves 66, 68 being exaggerated in the drawing. The width of each groove is greater than the wall thickness of each of the spacers 36 and 38 to permit the end of each spacer to freely enter into and bottom out on the bottoms of the grooves. The square holes in the discs 32, 34 and 42 preferably have enlarged, radiused corner portions to clear the corners of the square shafts and eliminate stress points. The locating disc 40 is of a precise, predetermined thickness, this thickness being the same as that of each of the portions of the discs 32, 34 and 42 between the bottoms of the grooves.

In assembling the discs upon the shafts, a shaft such as the shaft 20 with the center locating ring 40 welded in place first has two short spacers 70 positioned on opposite sides of the ring 40. The length of these spacers is such that the next adjacent discs will be correctly spaced apart. Then spacers 36 and discs 32 are alternately slid into place from the opposite ends of the shaft until the desired number are in place. The end plates 52 are then secured in place to lock the discs in position on the shaft 20.

In similar manner the discs 34 and spacers 38 are mounted and locked in place on the shaft 26 upon opposite sides of the locating disc 42. The shafts 20, 26 are then mounted alternately on the frame 10, care being taken that the locating disc 42 or ring 40 of each shaft is aligned with all of the similar rings or discs. Because of theminimization of the warpage effect and the fixing of a mounting loci on each shaft, minimum spacing clearances can be utilized without encountering interference problems between discs of adjacent shafts.

In operation the shafts 20, 26 are connected to a suitable drive mechanism (not shown) so that each is driven in the same direction. Material to be separated or graded is then fed on to the top of the table of discs at the feed end. The motion of the discs will cause the material supported on the discs to be propelled toward the opposite end of the table. Material having a dimension less than the spacing between the interleaved discs will fall through between the discs, the larger material being carried on the top eventually to be discharged off the end opposite the feed end. Many types of materials can be processed. For example, pulp chips can be separated from knots, wood chunks, frozen lumps or the like. Disintegrated materials such as ground up domestic waste can be screened to separate the finer particles for combustion processes from the larger particles for other types of processing.

The feeder discs 32, 34 preferably are toothed or star-shaped to facilitate feeding large particles or lumps lengthwise of the separator while permitting the smaller fragments to fall freely between the overlapping discs.

While the illustrated embodiment shows the discs 32, 34 as uniformly spaced on each shaft, it will be apparent to those skilled in the art that the discs need not be so spaced. For example, it may be desirable to increase the spacing from the feed end of the separator to the other. Material fed on to end of the separator wherein the discs are most closely spaced will be in effect graded since progressively larger material can fall through the spaces between the discs as the material to be screened is conveyed on top of the discs from the feed end of the separator toward the opposite end.

It will also be apparent the mounting system utilized permits initial assembly of the discs in any desired spacing merely by proper selection of the length of the spacers 36, 38. Likewise, if it is desired to change the spacing at any time this can easily be done by disassembling the shafts and substituting new spacers of the desired new spacing.

Having illustrated a preferred embodiment of the invention, it will be apparent to those skilled in the art that it permits of modification in arrangement and detail.

What is claimed is:

1. In an improved separator,
a first shaft,
a second shaft,
means journalling the shafts in parallel positions,
a plurality of first spacers slidable on the first shaft,
a plurality of first feed discs splined to the first shaft and positioned between the first spacers,
a plurality of second spacers slidable on the second shaft,
a plurality of second feed discs splined to the second shaft and positioned between the second spacers,
locating means for positioning said feed discs comprising, first locating means fixed to the first shaft at a predetermined point along the length thereof,
second locating means fixed to the second shaft at a point therealong such that the second locating means is laterally aligned with the first locating means,
said first locating means being parallel to said first feed discs and extending radially around said shaft beyond the internal periphery of said spacers to form a stop abutment,
said second locating means being parallel to said second feed discs and extending radially around said shaft beyond the internal periphery of said spacers to form a stop abutment,
first retaining means pressing the first spacers and first feed discs snugly together and snugly against opposite sides of the first locating means,
and second retaining means pressing the second spacers and the second feed discs snugly together and snugly against the opposite sides of the second locating means.

2. The improved separator of claim 1 wherein the first locating means is a circular ring and the second locating means is a feed disc.

3. The improved separator of claim 2 wherein the feed discs have shallow annular grooves therein receiving the end portions of the spacers.

4. The improved separator of claim 3 wherein each feed disc has a pair of the annular grooves in opposite sides thereof.

5. The improved separator of claim 1 wherein the feed discs have shallow annular grooves therein receiving the end portions of the spacers.

6. The improved separator of claim 5 wherein each feed disc has a pair of the annular grooves in opposite sides thereof.

* * * * *